US005551643A

United States Patent [19]

Chapin

[11] Patent Number: 5,551,643

[45] Date of Patent: Sep. 3, 1996

[54] FLUORESCENT TUBE BREAKER APPARATUS

[76] Inventor: Michael Chapin, 14673 SE. Sterling Ct., Clackamas, Oreg. 97015-8292

[21] Appl. No.: 524,992

[22] Filed: Sep. 8, 1995

[51] Int. Cl.[6] ..... B02C 19/14

[52] U.S. Cl. ..... 241/99; 241/168

[58] Field of Search ..... 241/99, 168, 169, 241/100

[56] References Cited

U.S. PATENT DOCUMENTS

| | | | |
|---|---|---|---|
| 1,225,624 | 5/1917 | Haller | 241/99 X |
| 2,235,712 | 3/1941 | Lehr | 241/99 X |
| 3,330,489 | 7/1967 | Worman | 241/99 |
| 3,589,884 | 6/1971 | Guiriec . | |
| 3,828,976 | 8/1974 | Sidelinker | 241/99 X |
| 4,537,361 | 8/1985 | Heimerich . | |
| 4,579,287 | 4/1986 | Brown . | |
| 4,662,535 | 5/1987 | Loveland . | |
| 4,693,403 | 9/1987 | Sprouse . | |
| 4,834,239 | 5/1989 | Osgood . | |
| 4,953,701 | 9/1990 | Maddock . | |
| 5,165,610 | 11/1992 | Pendleton . | |
| 5,215,265 | 6/1993 | Lodovico . | |
| 5,350,121 | 9/1994 | Vitunac et al. . | |
| 5,351,896 | 10/1994 | Nuttall . | |

FOREIGN PATENT DOCUMENTS

| | | | |
|---|---|---|---|
| 96630 | 6/1984 | Japan | 241/99 |

*Primary Examiner*—Mark Rosenbaum

[57] ABSTRACT

A fluorescent tube breaker apparatus includes a housing assembly which defines a bulb-receiving chamber for receiving a fluorescent tube. The housing assembly includes a first end portion, a body portion, and a second end portion. The second end portion is selectively removable and replaceable with respect to the body portion, and the body portion includes a spike-receiver aperture. A tube breaker assembly is connected to the housing assembly and includes a housing-connection portion connected to the housing assembly. A hinge portion is connected to the housing-connection portion. A lever portion is connected to the hinge portion, and a spike portion is connected to the lever portion. The spike portion projects from the lever portion and is in registration with the spike-receiver aperture of the body portion of the housing assembly. The spike portion includes a connected end which is connected to the lever portion of the tube breaker assembly. A main body of the spike portion is connected to the connected end. A free tip end is connected to the main body. A spring member is positioned between the lever portion of the tube breaker assembly and the body portion of the housing assembly. The spring member normally positions the lever portion with respect to the body portion such that the main body of the spike portion is normally positioned outside of the bulb-receiving chamber.

9 Claims, 3 Drawing Sheets

FLUORESCENT TUBE BREAKER APPARATUS

BACKGROUND OF THE INVENTION

1. Field of the Invention

The present invention relates generally to devices for breaking illumination devices and, more particularly, to a device especially adapted for breaking fluorescent tubes.

2. Description of the Prior Art

Fluorescent tubes are generally long and slender glass devices that are easily broken. For purposes of discussion, a fluorescent tube will be considered to have three stages in its life cycle. In the first stage, the fluorescent tube is new and has not been used. In the first stage, it is important to protect a fluorescent tube from breakage while it is in storage and while it is transported to a site where it will be used. In this respect, it would be desirable if a device were provided that enables a fluorescent tube to be protected from breakage while it is transported to a site to be used.

After a fluorescent tube is burned out, the fluorescent tube must be transported to an appropriate disposal site. However, for safety purposes, the fluorescent tube should not be broken until the appropriate disposal site is reached. In this respect, it would be desirable if a device were provided that protects a burned out fluorescent tube; from breakage as it is being transported to a disposal site.

Once a fluorescent tube reaches a disposal site, the fluorescent tube should be broken in such a manner that flying pieces of broken glass cannot endanger a person who breaks the fluorescent tube. In this respect, it would be desirable if a device were provided that prevents a person from being exposed to flying glass when a fluorescent tube is broken.

Throughout the years, a number of innovations have been developed relating to storage and disposal of cylindrical objects such as fluorescent tubes, and the following U.S. patents are representative of some of those innovations: U.S. Pat. Nos. 4,579,287, 4,662,535, 4,953,701, and 5,351,896. More specifically, U.S. Pat. No. 4,579,287 discloses a motorized device that employs rotating chains for pulverizing fluorescent tubes. To avoid complexities and expense, and to avoid the need for electric or gasoline power, it would be desirable if a device were provided for disposal of fluorescent tubes that does not employ a motor and does not require a source of electrical or gasoline power.

U.S. Pat. No. 4,662,535 provides a closely fitting bendable tube that receives a fluorescent tube. The fluorescent tube is broken when inside the closely fitting bendable tube. Fluorescent tubes come in a variety of cylindrical radii. Therefore, a single closely fitting tube could not be provided to accommodate fluorescent tubes of a variety of radii. In this respect, it would be desirable if a fluorescent tube carder could accommodate fluorescent tubes having a variety of cylindrical radii.

U.S. Pat. No. 4,953,701 discloses a fluorescent tube carrier that has a plurality of holes arrayed along the body portion of the carrier. Pins can be inserted through the holes to break the fluorescent tube contained in the carrier. The pins are not part of the carrier. As a consequence, separate pins may be easily forgotten or lost. In this respect, it would be desirable if a device were provided for transporting and disposal of a fluorescent tube which includes a pin integrated into the structure of the device. In this way, a pin cannot be easily lost or forgotten.

U.S. Pat. No. 5,351,896 discloses a fluorescent tube breaking apparatus which employs a guide tube and an impact rod directed through the guide tube to the fluorescent tube contained inside the apparatus. Just as with separate pins discussed above, the impact rod may be easily forgotten or lost.

Still other features would be desirable in a fluorescent tube breaker apparatus. For example, when a cap is removed from a housing that receives a fluorescent tube, the cap may be easily lost or misplaced. In this respect, it would be desirable if a device were provided that tethers a cap to the housing for the fluorescent tube.

Thus, while the foregoing body of prior art indicates it to be well known to use fluorescent tube breaker devices, the prior art described above does not teach or suggest a fluorescent tube breaker apparatus which has the following combination of desirable features: (1) enables a fluorescent tube to be protected from breakage while it is transported to a site to be used; (2) protects a burned out fluorescent tube from breakage as it is being transported to a disposal site; (3) prevents a person from being exposed to flying glass when a fluorescent tube is broken; (4) does not employ a motor and does not require a source of electrical or gasoline power; (5) can accommodate fluorescent tubes having a variety of cylindrical radii; (6) includes a pin integrated into the structure of the device; and (7) tethers a cap to the housing for the fluorescent tube. The foregoing desired characteristics are provided by the unique fluorescent tube breaker apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a fluorescent tube breaker apparatus which includes a housing assembly which defines a bulb-receiving chamber for receiving a fluorescent tube. The housing assembly includes a first end portion, a body portion connected to the first end portion, and a second end portion connected to the body portion. The second end portion is selectively removable and replaceable with respect to the body portion, and the body portion includes a spike-receiver aperture. A tube breaker assembly is connected to the housing assembly. The tube breaker assembly includes a housing-connection portion connected to the housing assembly. A hinge portion is connected to the housing-connection portion. A lever portion is connected to the hinge portion, and a spike portion is connected to the lever portion. The spike portion projects from the lever portion and is in registration with the spike-receiver aperture of the body portion of the housing assembly. The spike portion includes a connected end which is connected to the lever portion of the tube breaker assembly. A main body of the spike portion is connected to the connected end. A free tip end is connected to the main body. A spring member is positioned between the lever portion of the tube breaker assembly and the body portion of the housing assembly. The spring member for normally positions the lever portion with respect to the body portion such that the main body of the spike portion is normally positioned outside of the bulb-receiving chamber.

In one embodiment, the hinge portion is comprised of a resilient spring material and serves as the spring member for normally positioning the main body of the spike portion outside of the bulb-receiving chamber. The resilient-spring-material-containing hinge portion normally orients the lever portion of the tube breaker assembly at an obtuse angle with respect to the housing-connection portion of the tube breaker assembly so that the connected end and the main body of the spike portion are normally positioned outside of the bulb-receiving chamber. In the first embodiment of the invention, the housing-connection portion, the hinge portion, and the lever portion of the tube breaker assembly are formed as a unified, integrated structure made from resilient material.

The spike portion includes a main body that is sufficiently long such that the free tip end of the spike portion can contact and break any fluorescent tube that fits into the housing assembly.

A tether assembly is connected between the body portion of the housing assembly and the removable and replaceable second end portion of the housing assembly.

In a second embodiment, the spring member includes a spiral spring which is positioned between the lever portion of the tube breaker assembly and the body portion of the housing assembly. The spiral spring encompasses the spike portion of the tube breaker assembly.

A pad member is attached to the body portion of the housing assembly. The pad member encompasses the spike-receiver aperture in the body portion and is placed between the spiral spring and the body portion in registration with the spiral spring.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fluorescent tube breaker apparatus which has all of the advantages of the prior art and none of the disadvantages.

It is another object of the present invention to provide a new and improved fluorescent tube breaker apparatus which may be easily and efficiently manufactured and marketed.

It is a further object of the present invention to provide a new and improved fluorescent tube breaker apparatus which is of durable and reliable construction.

An even further object of the present invention is to provide a new and improved fluorescent tube breaker apparatus which is susceptible of a low cost of manufacture with regard to both materials and labor, and which accordingly is then susceptible of low prices of sale to the consuming public, thereby making such fluorescent tube breaker apparatus available to the buying public.

Still yet a further object of the present invention is to provide a new and improved fluorescent tube breaker apparatus which enables a fluorescent tube to be protected from breakage while it is transported to a site to be used.

Still another object of the present invention is to provide a new and improved fluorescent tube breaker apparatus that protects a burned out fluorescent tube from breakage as it is being transported to a disposal site.

Yet another object of the present invention is to provide a new and improved fluorescent tube breaker apparatus which prevents a person from being exposed to flying glass when a fluorescent tube is broken.

Even another object of the present invention is to provide a new and improved fluorescent tube breaker apparatus that does not employ a motor and does not require a source of electrical or gasoline power.

Still a further object of the present invention is to provide a new and improved fluorescent tube breaker apparatus which can accommodate fluorescent tubes having a variety of cylindrical radii.

Yet another object of the present invention is to provide a new and improved fluorescent tube breaker apparatus that includes a pin integrated into the structure of the device.

Still another object of the present invention is to provide a new and improved fluorescent tube breaker apparatus which tethers a cap to the housing for the fluorescent tube.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
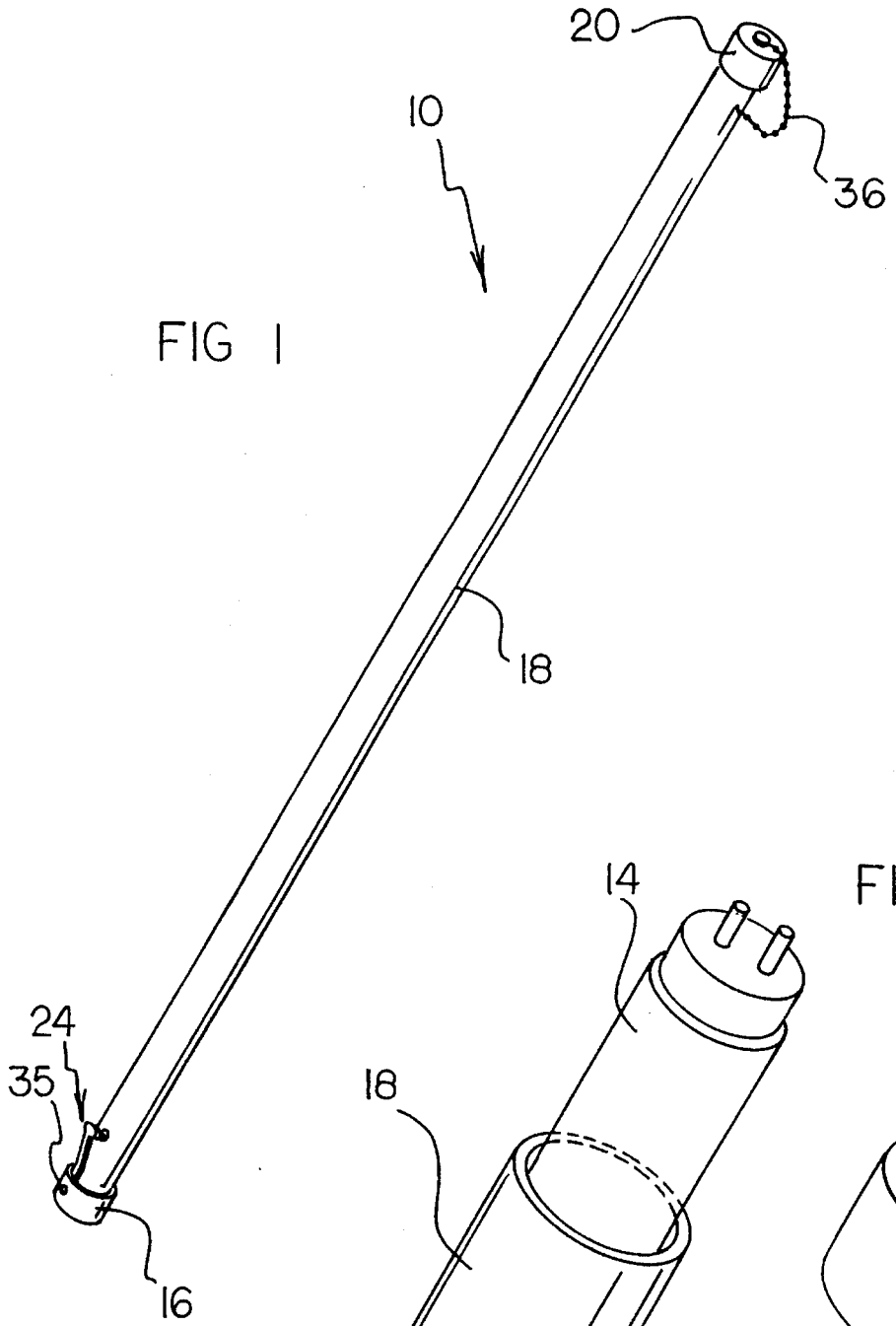
FIG. 1 is a perspective view showing a first embodiment of the fluorescent tube breaker apparatus of the invention that is closed.
Figure 2:
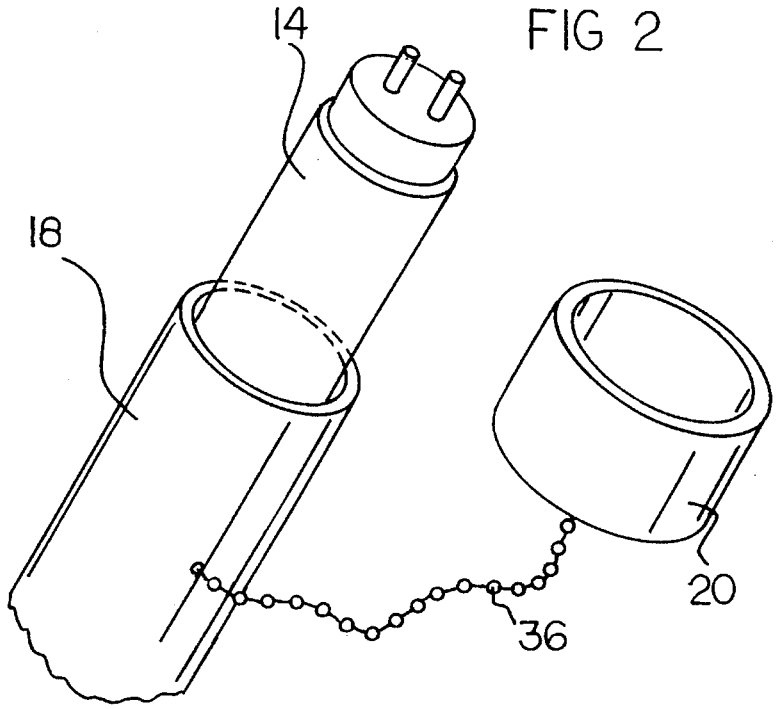
FIG. 2 is an enlarged perspective view of a top portion of the embodiment of the fluorescent tube breaker apparatus shown in FIG. 1 which is open and receiving a fluorescent tube.
Figure 3:
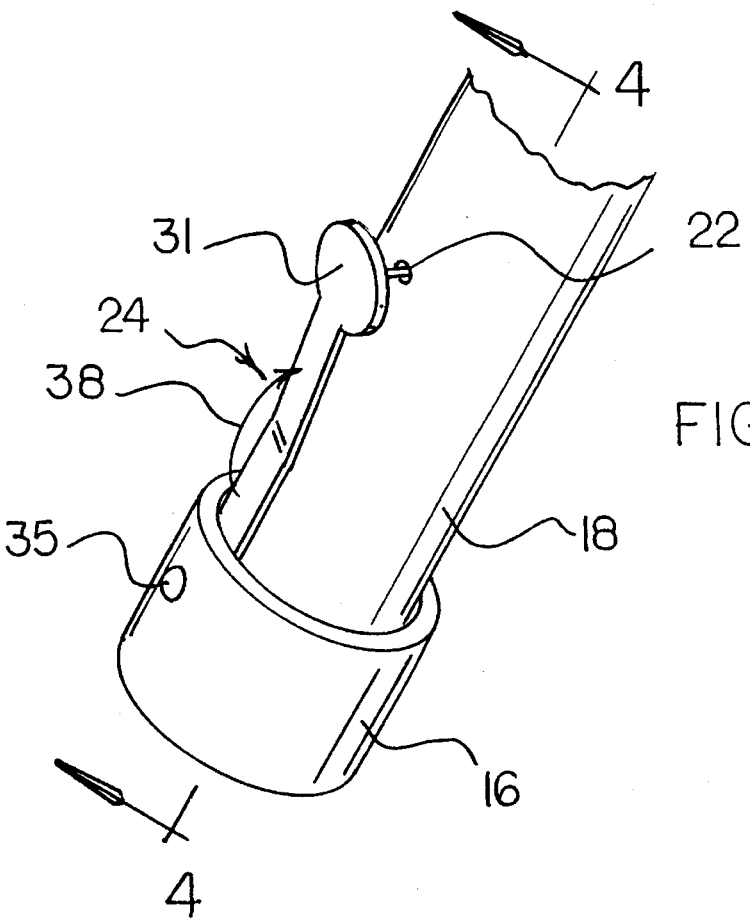
FIG. 3 is an enlarged perspective view of a bottom portion of the embodiment of the fluorescent tube breaker apparatus shown in FIG. 1.
Figure 4:
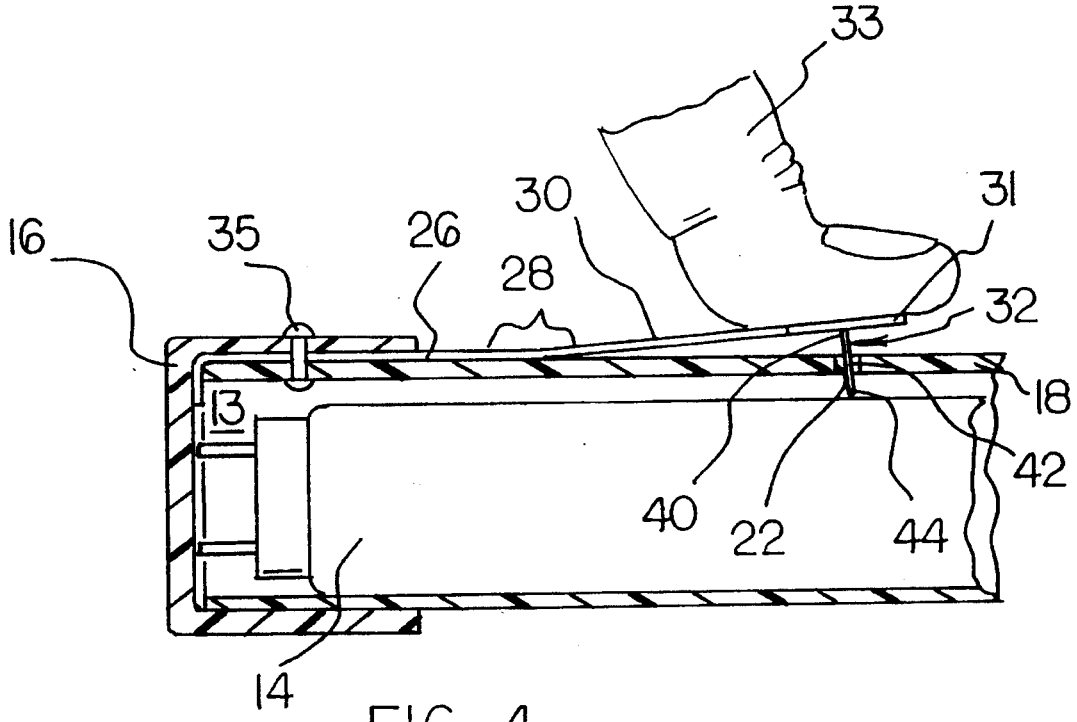
FIG. 4 is a cross-sectional view of the portion of the embodiment of the fluorescent tube breaker apparatus of FIG. 3 taken along line 4—4 thereof.

With reference to the drawings, a new and improved fluorescent tube breaker apparatus embodying the principles and concepts of the present invention will be described.

Turning to FIGS. 1–4, there is shown a first exemplary embodiment of the fluorescent tube breaker apparatus of the invention generally designated by reference numeral 10. In the first embodiment, the fluorescent tube breaker apparatus 10 includes a housing assembly which defines a bulb-receiving chamber 13 for receiving a fluorescent tube 14. The housing assembly includes a first end portion 16, a body portion 18 connected to the first end portion 16, and a second end portion 20 connected to the body portion 18. The second end portion 20 is selectively removable and replaceable with respect to the body portion 18, and the body portion 18 includes a spike-receiver aperture 22. A tube breaker assembly 24 is connected to the housing assembly. The tube breaker assembly 24 includes a housing-connection portion 26 connected to the housing assembly. A hinge portion 28 is connected to the housing-connection portion 26. A lever portion 30 is connected to the hinge portion 28, and a spike portion 32 is connected to the lever portion 30. The spike portion 32 projects from the lever portion 30 and is in registration with the spike-receiver aperture 22 of the body portion 18 of the housing assembly. The spike portion 32 includes a connected end 40 which is connected to the lever portion 30 of the tube breaker assembly 24. A main body 42 of the spike portion 32 is connected to the connected end 40. A free tip end 44 is connected to the main body 42. A spring member is positioned between the lever portion 30 of the tube breaker assembly 24 and the body portion 18 of the housing assembly. The spring member normally positions the lever portion 30 with respect to the body portion 18 such that the main body 42 of the spike portion 32 is normally positioned outside of the bulb-receiving chamber 13.

In one embodiment of the fluorescent tube breaker apparatus 10 of the invention, the hinge portion 28 is comprised of a resilient spring material and serves as the spring for normally positioning the main body 42 of the spike portion 32 outside of the bulb-receiving chamber 13. The resilient-spring-material-containing hinge portion 28 normally orients the lever portion 30 of the tube breaker assembly 24 at an obtuse angle 38 with respect to the housing-connection portion 26 of the tube breaker assembly 24 so that the connected end 40 and the main body 42 of the spike portion 32 are normally positioned outside of the bulb-receiving chamber 13. In the first embodiment of the invention, the housing-connection portion 26, the hinge portion 28, and the lever portion 30 of the tube breaker assembly 24 are formed as a unified, integrated structure made from resilient material. The resilient material can be spring steel.

The spike portion 32 includes a main body 42 that is sufficiently long such that the free tip end 44 of the spike portion 32 can contact and break any fluorescent tube that fits into the housing assembly.

A tether assembly 36 is connected between the body portion 18 of the housing assembly and the removable and replaceable second end portion 20 of the housing assembly.

In using the first embodiment of the invention, the second end portion 20 of the housing assembly is removed from the body portion 18 whereby access is gained to the bulb-receiving chamber 13. A fluorescent tube 14 is inserted into the bulb-receiving chamber 13. The tether assembly 36 prevents the second end portion 20 from being lost, and the second end portion 20 is replaced back on the body portion 18. The second end portion 20 can be in the form of a cap attached to the body portion 18 by any suitable such as a friction fit as shown in FIG. 1.

When it is desired to break the fluorescent tube 14 retained in the bulb-receiving chamber 13, a person presses down in the lever portion 30 of the tube breaker assembly 24. More specifically, the lever portion 30 has an enlarged finger-receiving region 31. When one of the person's fingers 33 presses the lever portion 30 down, the spring nature of the resilient hinge portion 28 of the tube breaker assembly 24 is overcome, and the main body 42 of the spike portion 32 is pushed through the spike-receiver aperture 22 in the body portion 18 so that the free tip end 44 of the spike portion 32 impacts the fluorescent tube 14, whereby the fluorescent tube 14 breaks. Once the fluorescent tube 14 is broken, the person's finger 33 is removed from the lever portion 30, and the resilient nature of the hinge portion 28 causes the lever portion 30 to return to its normal position with respect to the body portion 18, whereby the main body 42 of the spike portion 32 is withdrawn from the bulb-receiving chamber 13.

When the broken fluorescent tube 14 is to be removed from the bulb-receiving chamber 13, the second end portion 20 is removed, and the housing assembly is turned upside down so that the broken contents of the fluorescent tube 14 inside the bulb-receiving chamber 13 can be dumped out. As shown in greatest detail in FIG. 4, the first end portion 16 of the housing assembly may be attached to the body portion 18 by of one or more rivets 35.

Figure 5:
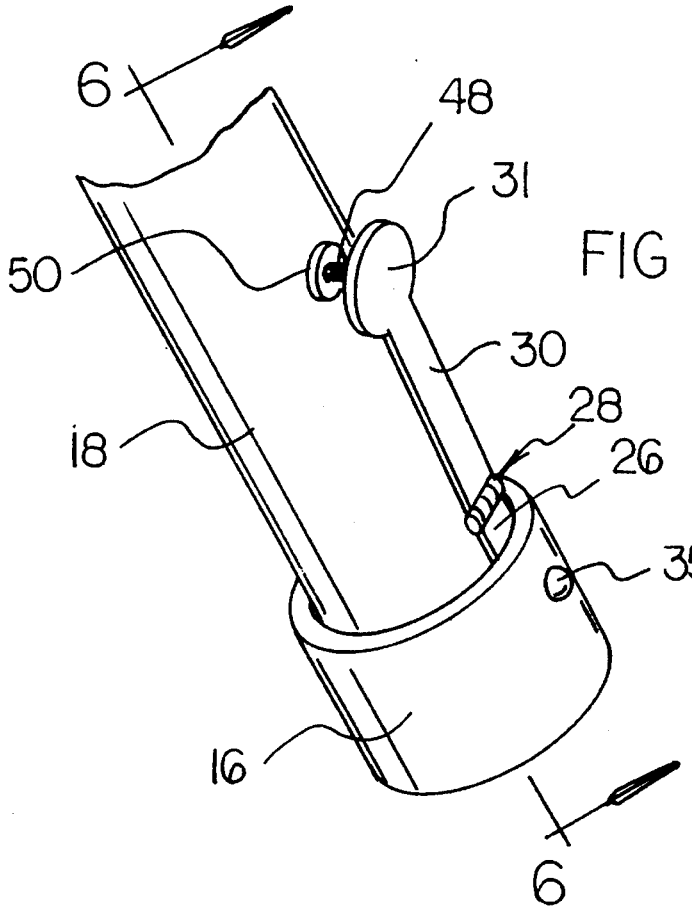
FIG. 5 is a perspective view of a bottom portion of a second embodiment of the fluorescent tube breaker apparatus.
Figure 6:
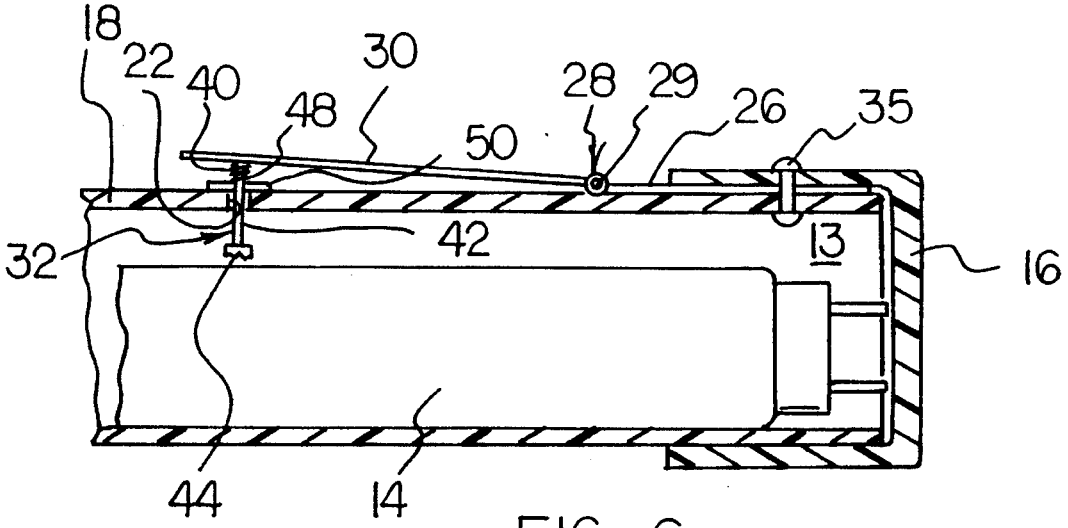
FIG. 6 is a cross-sectional view of the portion of the embodiment of the fluorescent tube breaker apparatus of FIG. 5 taken along line 6—6 thereof.

Turning to FIGS. 5–6, a second embodiment of the invention is shown. Reference numerals are shown that correspond to like reference numerals that designate like elements shown in the other figures. Furthermore, the spring includes a spiral spring 48 which is positioned between the lever portion 30 of the tube breaker assembly 24 and the body portion 18 of the housing assembly. The spiral spring 48 encompasses the spike portion 32 of the tube breaker assembly 24.

A pad member 50 is attached to the body portion 18 of the housing assembly. The pad member 50 encompasses the spike-receiver aperture 22 in the body portion 18 and is placed between the spiral spring 48 and the body portion 18 in registration with the spiral spring 48.

The operation of the second embodiment of the invention is similar in most respects to the operation of the first embodiment of the invention. A difference in the mode of operation of the second embodiment of the invention resides in the fact that the hinge portion 28 contains a pivot pin 29 and does not contain resilient spring properties. Instead, the spiral spring 48 provides the resilient properties for normally positioning the main body 42 of the spike portion 32 outside of the bulb-receiving chamber 13. In operation, the spiral spring 48 urges the lever portion 30 of the tube breaker assembly 24 into an elevated position by which the main body 42 of the spike portion 32 is positioned outside of the bulb-receiving chamber 13. When the lever portion 30 is pressed down, the main body 42 of the spike portion 32 passes through the spike-receiver aperture 22 in the body portion 18 of the housing assembly and into the bulb-receiving chamber 13 to enable the free tip end 44 of the spike portion 32 to break a fluorescent tube 14.

The components of the fluorescent tube breaker apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved fluorescent tube breaker apparatus that is low in cost, relatively simple in design and operation, and which may advantageously be used to enable a fluorescent tube to be protected from breakage while it is transported to a site to be used. With the invention, a fluorescent tube breaker apparatus is provided which protects a burned out fluorescent tube from breakage as it is being transported to a disposal site. With the invention, a fluorescent tube breaker apparatus is provided which prevents a person from being exposed to flying glass when a fluorescent tube is broken. With the invention, a fluorescent tube breaker apparatus is provided which does not employ a motor and does not require a source of electrical or gasoline power. With the invention, a fluorescent tube breaker apparatus is provided which can accommodate fluorescent tubes having a variety of cylindrical radii. With the invention, a fluorescent tube breaker apparatus is provided which includes a pin integrated into the structure of the device. With the invention, a fluorescent tube breaker apparatus is provided which tethers a cap to the housing for the fluorescent tube.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the United States is as follows:

1. A fluorescent tube breaker apparatus, comprising:

a housing assembly which defines a bulb-receiving chamber for receiving a fluorescent tube, wherein said housing assembly includes a first end portion, a body portion connected to said first end portion, and a second end portion connected to said body portion, wherein said second end portion is selectively removable and replaceable with respect to said body portion, and wherein said body portion includes a spike-receiver aperture, a tube breaker assembly connected to said housing assembly, wherein said tube breaker assembly includes a housing-connection portion connected to said housing assembly, a hinge portion connected to said housing-connection portion, a lever portion connected to said hinge portion, and a spike portion connected to said lever portion, wherein said spike portion projects from said lever portion and is in registration with said spike-receiver aperture of said body portion of said housing assembly, wherein said spike portion includes a connected end which is connected to said lever portion of said tube breaker assembly, a main body connected to said connected end, and a free tip end connected to said main body, and spring means, positioned between said lever portion of said tube breaker assembly and said body portion of said housing assembly, for normally positioning said lever portion with respect to said body portion such that said main body of said spike portion is normally positioned outside of said bulb-receiving chamber.

2. The apparatus of claim 1 wherein said hinge portion is comprised of a resilient spring material and serves as said spring means for normally positioning said main body of said spike portion outside of said bulb-receiving chamber.

3. The apparatus of claim 2 wherein said resilient-spring-material-containing hinge portion normally orients said lever portion of said tube breaker assembly with respect to said housing-connection portion of said tube breaker assembly at an obtuse angle such that said connected end and said main body of said spike portion are normally positioned outside of said bulb-receiving chamber.

4. The apparatus of claim 1 wherein said housing-connection portion, said hinge portion, and said lever portion of said tube breaker assembly are formed as a unified, integrated structure made from resilient material.

5. The apparatus of claim 1 wherein said spike portion includes a main body that is sufficiently long such that said free tip end can contact and break any fluorescent tube that fits into said housing assembly.

6. The apparatus of claim 1, further including:

a tether assembly connected between said body portion of said housing assembly and said removable and replaceable second end portion of said housing assembly.

7. The apparatus of claim 1 wherein said spring means includes a spiral spring which is positioned between said lever portion of said tube breaker assembly and said body portion of said housing assembly.

8. The apparatus of claim 7 wherein said spiral spring encompasses said spike portion of said tube breaker assembly.

9. The apparatus of claim 8, further including:

a pad member attached to said body portion of said housing assembly, wherein said pad member encompasses said spike-receiver aperture in said body portion and is placed between said spiral spring and said body portion in registration with said spiral spring.

* * * * *